US009924817B1

(12) United States Patent
Winter et al.

(10) Patent No.: US 9,924,817 B1
(45) Date of Patent: Mar. 27, 2018

(54) SLEEVE FOR A GLASS BOTTLE

(71) Applicant: Tali Corp., San Francisco, CA (US)

(72) Inventors: Tal Winter, San Francisco, CA (US); Kyle Lamson, San Francisco, CA (US); Michael J. Strasser, San Francisco, CA (US)

(73) Assignee: Tali Corp., San Francisco, CA (US)

( * ) Notice: Subject to any disclaimer, the term of this patent is extended or adjusted under 35 U.S.C. 154(b) by 0 days.

(21) Appl. No.: 14/681,691

(22) Filed: Apr. 8, 2015

Related U.S. Application Data

(60) Provisional application No. 61/977,053, filed on Apr. 8, 2014.

(51) Int. Cl.

| | |
|---|---|
| ***A61J 9/08*** | (2006.01) |
| ***A47G 23/02*** | (2006.01) |
| *B65D 81/38* | (2006.01) |
| *A47G 23/03* | (2006.01) |

(52) U.S. Cl.
CPC ..... *A47G 23/0241* (2013.01); *A47G 23/02* (2013.01); *A47G 23/03* (2013.01); *A61J 9/08* (2013.01); *B65D 81/3876* (2013.01); *B65D 81/3883* (2013.01); *B65D 81/3888* (2013.01)

(58) Field of Classification Search
CPC ..... B65D 81/3876; B65D 81/3888; B65D 81/3883; A47G 23/0241; A47G 23/03; A47G 23/02; A47G 2023/0275; A47G 2023/0291; A61J 9/08
USPC .. 220/737, 903, 592.2, 592.17, 592.24, 738, 220/739, 902; 215/12.1, 384, 393, 395, 215/12.2, 13.1, 394, 396, 11.6; 62/457.1–457.9, 529, 530
See application file for complete search history.

(56) References Cited

U.S. PATENT DOCUMENTS

| | | | | |
|---|---|---|---|---|
| 2,115,654 | A * | 4/1938 | Swofford ..... | A47G 23/03 126/261 |
| D156,089 | S | 11/1949 | Fuerst | |
| 4,514,995 | A | 5/1985 | Curtis et al. | |
| 5,269,368 | A | 12/1993 | Schneider et al. | |
| 5,624,090 | A | 4/1997 | Gammelgaard | |
| D422,503 | S | 4/2000 | Lehn | |
| D431,735 | S | 10/2000 | Sullivan | |
| 6,158,870 | A | 12/2000 | Ramirez | |
| D481,937 | S | 11/2003 | McRae | |

(Continued)

*Primary Examiner* — J. Gregory Pickett
*Assistant Examiner* — Elizabeth Volz
(74) *Attorney, Agent, or Firm* — Loginov & Associates; William A. Loginov

(57) ABSTRACT

A sleeve for a glass bottle includes a first opening, a rounded shoulder below the first opening, a second opening counterposed to the first opening, a rounded shoulder above the second opening, a cylindrical body between the rounded shoulder below the first opening and the rounded shoulder above the second opening when the resides on a bottle. The sleeve is comprised of an elastomeric material and contracts at a point equidistant from the first and second openings when removed from the bottle. The sleeve contraction creates a pinch at the point equidistant from the first and second openings. The pinch is omnidirectional around the circumference of the sleeve. The diameter of the sleeve at the pinch is less than at least one of the diameter of the sleeve at the rounded shoulder below the first opening and the diameter of the sleeve at the rounded shoulder above the second opening.

17 Claims, 6 Drawing Sheets

(56) References Cited

U.S. PATENT DOCUMENTS

| | | | | |
|---|---|---|---|---|
| D482,607 | S | 11/2003 | McRae | |
| 7,152,750 | B2 * | 12/2006 | Coffey | A61J 9/08 215/11.6 |
| D539,607 | S | 4/2007 | Lapsker | |
| D543,776 | S | 6/2007 | Yelland | |
| D577,550 | S | 9/2008 | Pertuit | |
| D615,816 | S | 5/2010 | Joy et al. | |
| D616,703 | S | 6/2010 | Joy et al. | |
| D616,744 | S | 6/2010 | Cresswell et al. | |
| D618,065 | S | 6/2010 | Joy et al. | |
| D620,798 | S | 8/2010 | Cresswell et al. | |
| D621,257 | S | 8/2010 | Gullickson et al. | |
| D621,258 | S | 8/2010 | Gullickson et al. | |
| D621,259 | S | 8/2010 | Joy et al. | |
| 8,579,133 | B2 | 11/2013 | Marcus et al. | |
| 2003/0111375 | A1 | 6/2003 | Kilmartin | |
| 2009/0057257 | A1 * | 3/2009 | Marcus | A61J 9/08 215/11.6 |

* cited by examiner

SLEEVE FOR A GLASS BOTTLE

RELATED APPLICATION

This application claims the benefit of U.S. Provisional Application Ser. No. 61/977,053, filed Apr. 8, 2014, entitled PINCH WAISTED BOTTLE SLEEVE, the entire disclosure of which is herein incorporated by reference.

FIELD OF THE INVENTION

This invention relates to removable sleeves for glass bottles.

BACKGROUND OF THE INVENTION

Active lifestyles are mobile lifestyles, and water remains an essential part of life, so portable and safe liquid vessels are a part of modern life. Renewable and reusable water vessels offer and environmentally friendly alternative to the ubiquitous disposable plastic bottle. While convenient when introduced, the plastic bottle is now recognized as wasteful. Simple water can now be transformed into sports drinks and energy supplements by the introduction of concentrated additives. Another problem with conventional plastic bottles is the health risk posed by the various chemical ingredients used in creating the bottles. Some of the chemical components can pass into the contained liquids by a leaching process, placing the health of the consumer at risk. This can be particularly troublesome to the health conscious consumer.

A glass bottle is refillable, reusable and can be cleaned as needed. Glass vessels are not prone to contaminating the contents by leaching. Glass containers, which are predominantly silicon-dioxide structures, are stable and relatively free from contamination of their contents. However, glass bottles can be slippery to hold and are prone to breakage if dropped.

It would be desirable to provide a protective sleeve around the glass vessel that can be removed for cleaning and provides an adequate grip when in use and a resilient buffer if dropped.

SUMMARY OF THE INVENTION

The present invention overcomes the disadvantages of the prior art by providing a sleeve comprising a cylindrical body defining a first opening at a first end of the sleeve and a second opening at a second end of the sleeve, the cylindrical body having a midpoint disposed between the first opening and the second opening, such that when the sleeve is engaged with the glass bottle, a first dimension of the midpoint is greater than a second dimension of the first opening, and when the sleeve is not engaged with the glass bottle, the first dimension of the midpoint is less than the second dimension of the first opening. In one example, the sleeve is comprised of an elastomeric material. In one example, the sleeve contracts at a point equidistant from the first and second openings when removed and disengaged from a bottle. In one example, the sleeve contraction creates a pinch at the midpoint, the midpoint being equidistant from the first and second openings. In one example, the pinch is omnidirectional around the circumference of the sleeve. In one example, the first dimension of the sleeve at the midpoint is a first diameter, the first diameter being less than at least one of the diameter of the sleeve at the first opening and the diameter of the sleeve at the second opening. In one example, a thickness of the material of the sleeve at the pinch is greater than a thickness of the material of the sleeve at least one of the first opening and the second opening. In one example, a contraction to form a pinch is created by the contraction of the material at the midpoint equidistant from the first and second openings when removed and disengaged from a bottle. In one example, the material at the midpoint equidistant from the first and second openings stretches and thins as the sleeve is engaged and placed onto a water bottle. In another example, the thickness of the sleeve is uniform along the sleeve when engaged and encompassing a bottle. In another example, the sleeve is comprised of an elastomeric material of a uniform thickness. In another example, the sleeve forms a pinch at the midpoint equidistant from the first and second openings when removed and disengaged from the bottle. In another example, the pinch is monoaxial in orientation. In another example, a major diameter of the sleeve at the pinch along the axis is greater than at least one of the diameter of the sleeve at the first opening and the diameter of the sleeve at the second opening. In another example, the minor diameter of the sleeve at the pinch across the axis is less than at least one of the diameter of the sleeve at the first opening and the diameter of the sleeve at the second opening. A bottle is provided with a first sleeve that can be interchanged with a second sleeve.

BRIEF DESCRIPTION OF THE DRAWINGS

The invention description below refers to the accompanying drawings, of which.

DETAILED DESCRIPTION

Figure 1:
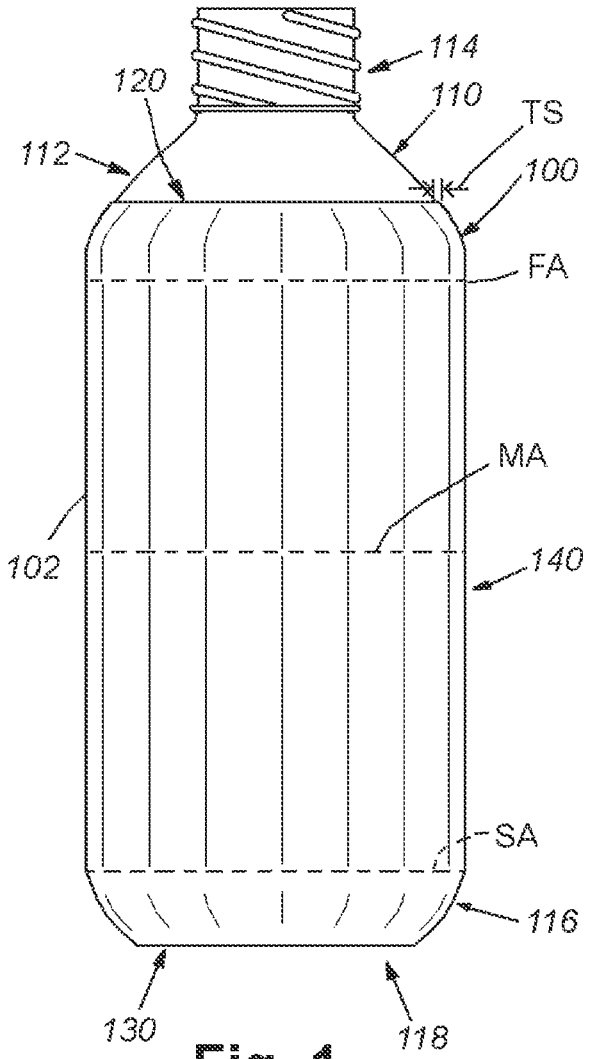
FIG. 1 is a frontal view of a bottle with a sleeve, according to a first illustrative embodiment.

FIG. 1 depicts an illustrative sleeve 100 removably attached to a bottle 110. In an embodiment, the sleeve 100 is constructed of an elastomeric polymer (for example, silicone). In an embodiment, the sleeve 100 material can be translucent and tinted with a visually pleasing color (for example, light pink or light blue). The sleeve 100 can also be adorned with patterns, logos, slogans, designs and other graphic work. While the sleeve 100 is decorative, it is protective as well. The bottle 110 is constructed of a glass compound. The sleeve 100 material is elastomeric and can absorb a certain amount of impact energy by compression of the material itself and by deforming its shape. The sleeve 100 is non-slippery and this enhances the consumer's grip upon the bottle and reduces the possibility that the bottle is accidently dropped.

The sleeve 100 defines a cylindrical shape when placed upon the bottle 110 with a first (e.g., "top") opening 120. The middle axis MA of the sleeve 100 is defined as a horizontal axis across the midpoint 140 of the sleeve, that being equidistant between the top opening 120 and a second ("base") opening 130. A first axis FA is defined as an axis that is near the top of the sleeve 100 at the point at which the shape of the bottle 110 transitions from a cylinder to a curved top portion 112, leading upwards to the neck 114. A second axis SA is defined as an axis that is near the bottom of the sleeve 100 at the point at which the shape of bottle 100 transitions from a cylinder to a curved base portion 116, leading downwards to the base 118. There is a base opening 130 at the base of the sleeve 100 that is counterpoised to the top opening. "Top" and "topmost" are each defined as a direction opposite "bottom" and "base", from the top opening 120 toward the base opening 130. "Up" and "upward" are each defined as a direction taken from the base and toward the top opening 120 with "top" being at the approximate maximum point "Down" and "downward" are each defined as a direction taken from the top opening 120 and toward the base opening 130 with "bottom" and/or "base" being at the approximate maximum point. "Interior" is defined as a region or surface facing the glass bottle 110 or in the open space within the sleeve 100, while "exterior" is defined as a region or surface facing away from the space of the interior and/or residing on an outside surface 102 of the sleeve and exposed to the outside environment. More generally, as used herein the directional terms, such as, but not limited to, "up" and "down", "upward" and "downward", "rearward" and "forward", "top" and "bottom", "inside" and "outer", "front" and "back", "inner" and "outer", "interior" and "exterior", "downward" and "upward", "horizontal" and "vertical" should be taken as relative conventions only, rather than absolute indications of orientation or direction with respect to a direction of the force of gravity.

The sleeve 100 has a uniform thickness TS of 1 mm when engaged with the bottle 110. The bottle 110 as shown in FIG. 1 is a bottle constructed and arranged with an interior volume of 0.5 ml. In other embodiments, the bottle 110 can be provided with an interior volume of 1.0 ml or another size volume.

Figure 2:
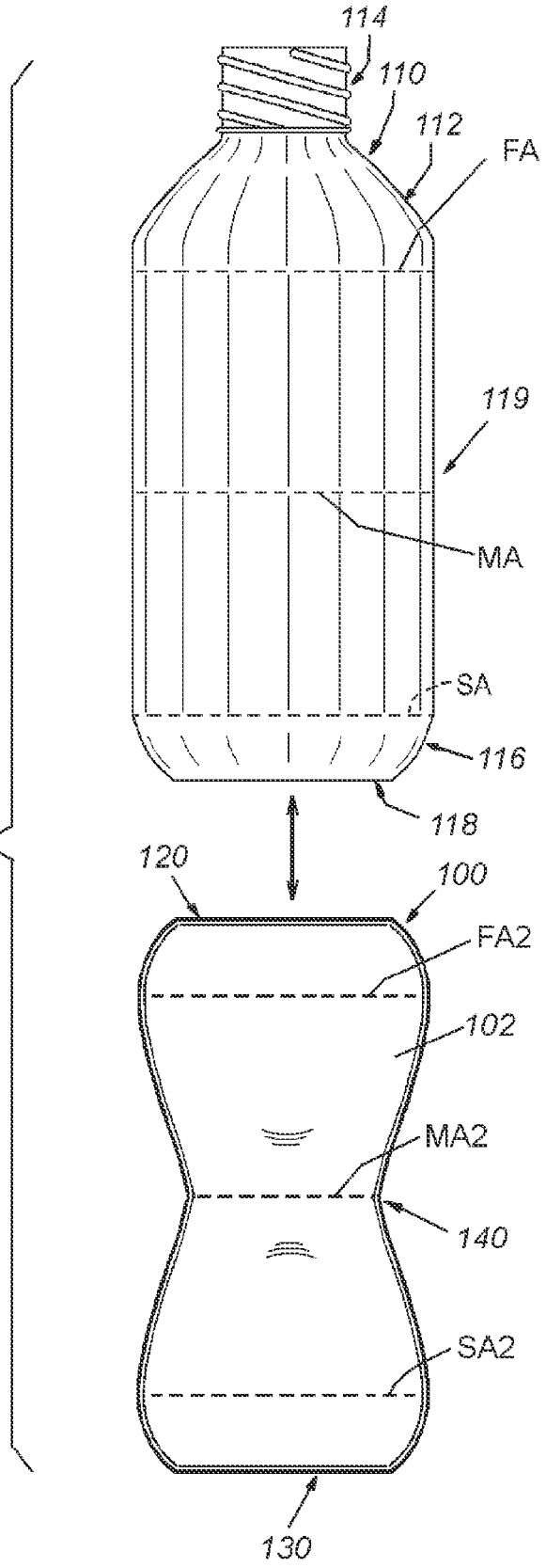
FIG. 2 is an exploded view of the bottle and the sleeve, according to the first illustrative embodiment.

FIG. 2 shows the sleeve 100 removed from the bottle 110. In this state, the sleeve and bottle can be cleaned separately. The sleeve 100 is depicted in its removed state and has a shape that is defined as an "hourglass" shape, with a diameter, circumference and cross-sectional area at the middle axis MA2 being less than a diameter of the sleeve at the first axis FA2 and openings and/or at the second axis SA2. To place the sleeve 100 over the bottle 110, the consumer places the base portion 118 of the bottle against the top opening 120 of the sleeve. The material of the sleeve 100 is elastic and can deform to stretch around the circumference of the base 118 by deformation and then passes along the curved base portion 116 to the barrel 119 of the bottle. The sleeve 100 can be manually rolled and/or unrolled, pulled, pushed or otherwise urged along the barrel 119 of the bottle until the top opening 120 passes the first axis FA and begins to retract in circumference along the curved top portion 122 until the base 118 of the bottle reaches the bottom opening 130 of the sleeve. During this engagement process, the middle axis MA2 of the sleeve deforms and the inner wall narrows (but not axis MA2) as it stretches outwardly to assume a uniform shape and thickness along the barrel 119 of the bottle 110. Removal of the sleeve 100 from the bottle 110 is followed in a reverse manner to that described above. The sleeve 100 is pliable when removed from the bottle and has a weight of about 4 ounces (113 grams). The weight of the sleeve can vary upwards or downwards, depending on the size of the sleeve and the weight of the materials.

The interior surface of the sleeve 100 is provided with a smooth texture to facilitate placing the sleeve onto the bottle and removing the sleeve from the bottle. The interior surface can include a layer of paint or other coating to enhance the removal and replacement of the sleeve. The interior surface can be machined to improve the removal and replacement. In another example, the interior surface can be textured that can engage with an exterior surface of the bottle. It is expressly contemplated that the user can exchange sleeves so that a plurality of sleeves of different designs, logos and artwork can be interchanged with one another. This interchangeability can reflect different fashions, attitudes and moods of the user. The bottle can be provided with a first sleeve that can be interchanged with a second sleeve and a multiplicity of sleeves can be provided with the bottle as part of a kit.

The "pinch" of the sleeve when not engaged with and residing on a bottle is omnidirectional and is defined as the narrowing of the sleeve at the midpoint such that the midpoint circumference and diameter of the cross-section at axis MA is less than the diameters at axes FA, SA and the openings. The diameter of the pinch is also less than the diameters of the top opening and/or the base opening. The sleeve contracts at a point equidistant from the first and second openings when removed and disengaged from the bottle.

The sleeve pinch is also a fold line across the body of the sleeve 100 and facilitates folding of the sleeve so that both end openings are in proximity to each other. This reduces the overall size and profile of the sleeve. The reduced size sleeve can be shipped more readily from the source of production and/or distribution to retailers and other distributors because the reduced size takes up a smaller volume than an unfolded sleeve and more can be placed into a shipping package, or a smaller package can be used. At the same time, the folded reduced volume saves on inventory storage. The resilient material of the sleeve unfolds without a permanent creasing and is readily placed onto a container.

Figure 3:
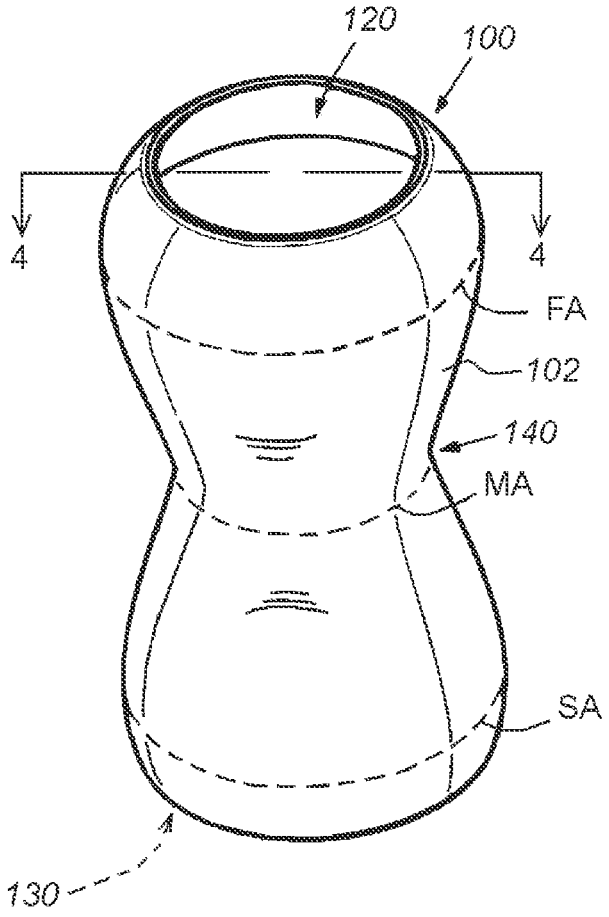
FIG. 3 is a perspective view of the sleeve, according to the first illustrative embodiment.

FIG. 3 is a perspective view of the illustrative sleeve 100 showing the top opening 120. The midpoint 140 defines a waist with a uniform (omnidirectional) pinch.

Figure 4:
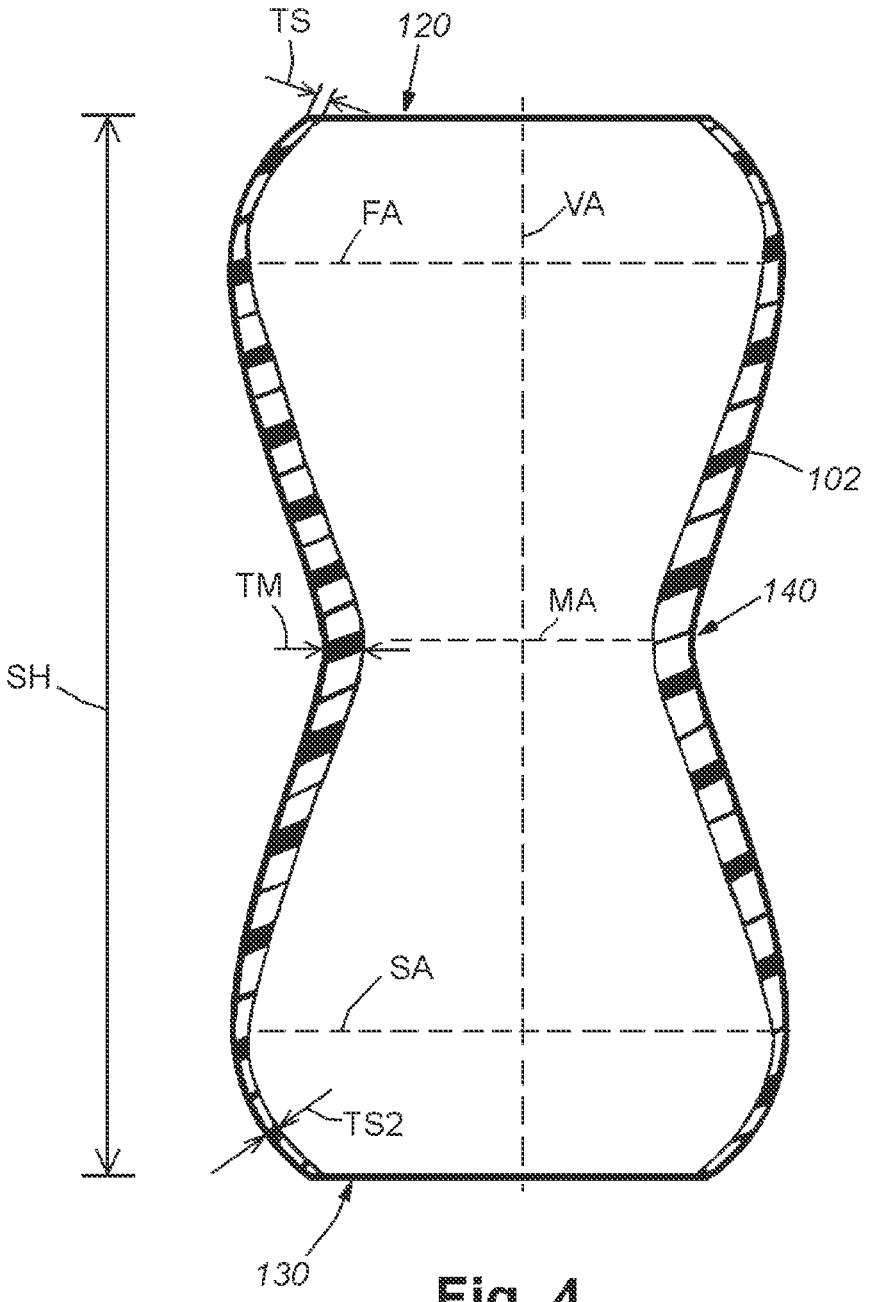
FIG. 4 is a cross-section view of the sleeve along the lines 4-4 of FIG. 3, according to the first illustrative embodiment.

FIG. 4 is a cross-section of the illustrative sleeve 100 along a vertical axis VA. The sleeve height SH is approximately 6 inches (15 cm) from the base opening 130 to the top opening 120. This height will vary depending on the size of the contained water bottle. For example, a sleeve enclosing a water bottle having a volumetric size of 1 liter has a greater height and overall size than a sleeve enclosing a bottle with a volumetric size of 0.5 liter. As stated above, the sleeve thickness TS at the top opening is approximately 1 mm. The sleeve thickness TS2 at the base opening 130 is also approximately 1 mm. The sleeve thickness tapers from its narrowest thicknesses at the top and base openings 120, 130 to a midpoint thickness TM of approximately 5 mm. The taper is uniform and omnidirectional from the relatively thin end openings to the relatively thick midpoint. When the sleeve 100 is placed onto the bottle, the sleeve stretches and the thickness at the midpoint transitions from 5 mm to 1 mm as the material uniformly stretches. In this embodiment, the stretching involves a uniform elastomeric deformation of the sleeve material. In other embodiments, the stretching can be accomplished with a vertical corrugation comprised of a plurality of vertical cuts in the material along the interior surface. The pinched waist of the sleeve 100 at the midpoint 140 is thus a thick waist that stretches outward to accommodate the enclosed bottom and contributes to a snug fit for the sleeve on the bottle.

Figure 5:
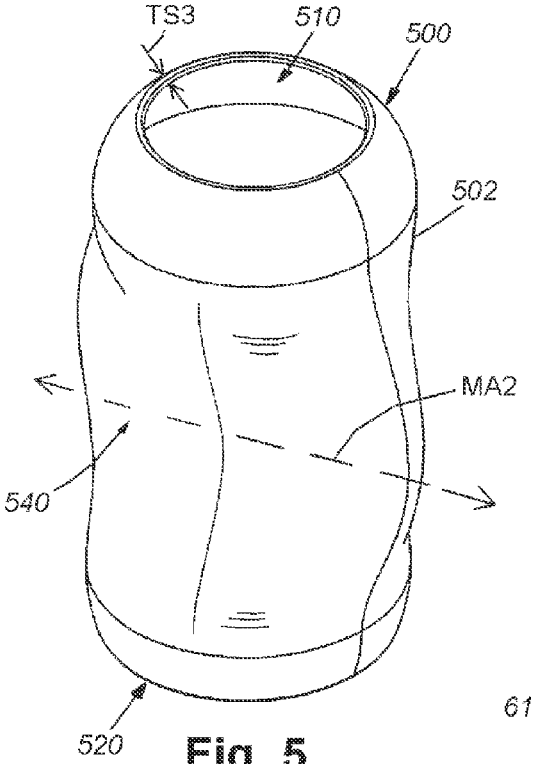
FIG. 5 is a perspective view of a sleeve, according to a second embodiment.
Figure 6:
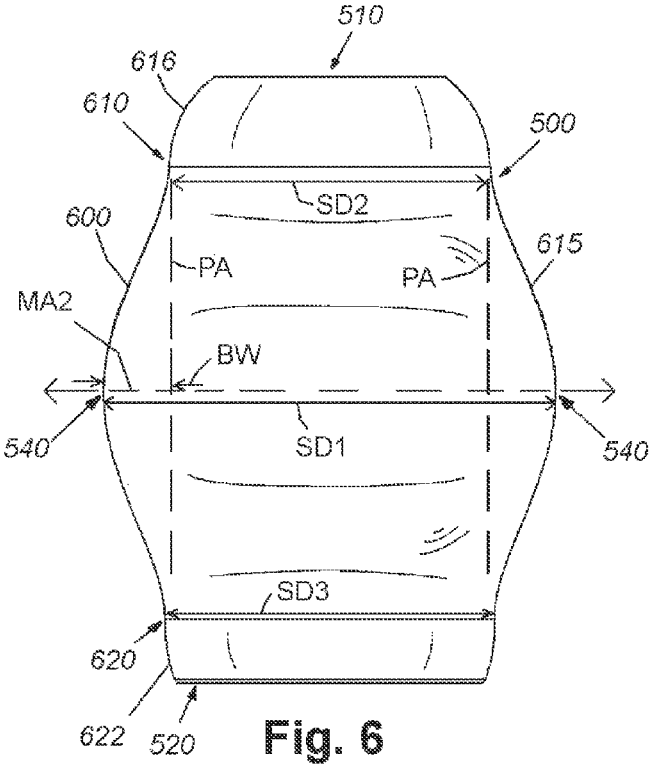
FIG. 6 is a front view of the sleeve, according to the second embodiment.
Figure 7:
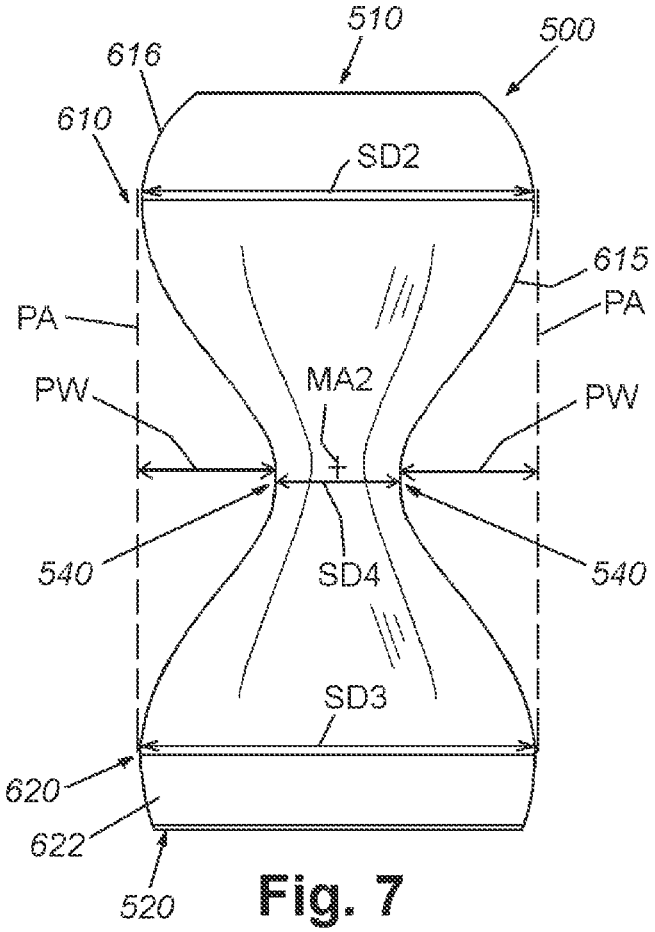
FIG. 7 is side view of the sleeve, according to the second embodiment.

FIGS. 5-7 depict an alternate embodiment of the sleeve that is defined by a pinch at the midpoint that is along an axis (e.g., "monoaxial" in oreintation), in contrast to the omnidirectional pinch as set forth above. With regard to FIG. 5, a sleeve 500 is provided with a uniform thickness TS3 of approximately 1 mm along the entire body 502 of the sleeve 500. The sleeve is provided with a top opening 510 and a base opening 520. At the midpoint 540, being defined as equidistant from the top opening 510 and the base opening 520, the sleeve is pinched along a midpoint axis MA2. The midpoint axis MA2 is a horizontal axis that transects the sleeve 500. The material of the sleeve is constructed so that when the sleeve is removed from the bottle, as depicted in FIGS. 5-7, there is a noticeable pinch at the midpoint.

FIG. 6 shows the pinch at the midpoint 540 in a front view. The exterior surface 600 of the sleeve 500 bulges at the midpoint 540 along axis MA2. The perimeter axis PA is a vertical axis drawn along the outer surface of the sleeve 500 when the sleeve is engaged with and residing on a water bottle and passes from a top shoulder point 610, where the sleeve geometry when residing on a bottle transitions from a cylindrical sleeve along the middle 615 of the sleeve to a first portion 616, defined as a top shoulder segment, to a bottom shoulder 620 where the sleeve geometry when residing on a bottle transitions from a cylindrical sleeve along the middle 615 of the sleeve to a second portion 622, defined as a bottom shoulder. The bulge at the midpoint 540 has a bulge width BW of approximately 1 inch (2.5 cm). The bulge is formed along axis MA2 and is monoaxial. The diameter of the sleeve SD1 from a midpoint 540 at one end of the axis to a midpoint 540 at the opposite end along the axis is greater than at least one of the diameter SD2 at top shoulder point 610 and diameter SD3 at bottom shoulder point 620 and the diameter of the top opening and/or the base opening. The sleeve geometry transitions from a pinch to cylindrical by engagement with the exterior of the water bottle. Placing the sleeve 500 onto the bottle and removing the sleeve follows the procedure as set forth above with the exception in this embodiment, it is the shape that changes, not the thickness.

FIG. 7 is a side view of the sleeve of FIG. 5 and depicts the axis MA2 as a point. The width PW is the difference between the perimeter axis PA and the midpoint 540. Width PW is approximately 1 inch (2.5 cm). Widths BW and PW will vary depending on the volumetric size of the engaged and enclosed water bottle. The diameter of the sleeve SD4 from a midpoint 540 at one side of the axis to a midpoint 540 at the opposite side across the axis is less than at least one of the diameter SD2 at top shoulder point 610 and diameter SD3 at bottom shoulder point 620. Thus, the diameter of the sleeve 500 at the midpoint 540 is at the same time both greater and lesser than the diameters at the top shoulder point 610 and the bottom shoulder point 620.

It should be clear from the foregoing that the sleeve as set forth above provides a soft and resilient sleeve for a water bottle that enhances control of the bottle in use and protection from accidents. The sleeve is removable and washable. When the sleeve is removed from the bottle, the material is constructed and arranged so that a pinch is formed. This pinch can be uniform and omnidirectional and created by a thickening of the material at the midpoint or monoaxial and formed in the molding process of a sleeve having a uniform thickness.

The foregoing has been a detailed description of illustrative embodiments of the invention. Various modifications and additions can be made without departing from the spirit and scope of this invention. Features of each of the various embodiments described above can be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, a sleeve material of less elasticity can be provided with a more "shallow" pinch and a reduced material thickness at the midpoint. As stated above, the midpoint material can have a series of vertical cuts along the interior surface of the sleeve. Accordingly, this description is meant to be taken only by way of example, and not to otherwise limit the scope of this invention.

What is claimed is:

1. An elastomeric sleeve for a glass bottle comprising:

a cylindrical body defining a first opening at a first end of the sleeve and a second opening at a second end of the sleeve, the cylindrical body comprising an elastomeric material that extends between the first opening and second opening, the cylindrical body having a midpoint disposed between the first opening and the second opening, such that when the sleeve is engaged with the glass bottle, a first dimension of the midpoint is greater than a second dimension of the first opening, and wherein the elastomeric sleeve is wrapped snugly around the glass bottle, and when the sleeve is not engaged with the glass bottle, the first dimension of the midpoint is less than the second dimension of the first opening.

2. The sleeve of claim 1 wherein the sleeve contracts at a point equidistant from the first and second openings when removed and disengaged from a bottle.

3. The sleeve of claim 2 wherein the contraction of the sleeve creates a pinch at the midpoint, the midpoint being equidistant from the first and second openings.

4. The sleeve of claim 3 wherein the pinch is omnidirectional around the circumference of the sleeve.

5. The sleeve of claim 4 wherein the first dimension of the sleeve at the midpoint is a first diameter, the first diameter being less than at least one of the diameter of the sleeve at the first opening and the diameter of the sleeve at the second opening.

6. The sleeve of claim 5 wherein a thickness of the material of the sleeve at the pinch is greater than a thickness of the material of the sleeve at at least one of the first opening and the second opening.

7. The sleeve of claim 6 wherein the contraction to form a pinch is created by the contraction of the material at the midpoint equidistant from the first and second openings when removed and disengaged from a bottle.

8. The sleeve of claim 7 wherein the material at the midpoint equidistant from the first and second openings stretches and thins as the sleeve is engaged and placed onto a water bottle.

9. The sleeve of claim 8 wherein the thickness of the sleeve is uniform along the sleeve when engaged and encompassing a bottle.

10. The sleeve of claim 1 wherein the sleeve is comprised of an elastomeric material of a uniform thickness.

11. The sleeve of claim 10 wherein the sleeve forms a pinch at the midpoint equidistant from the first and second openings when removed and disengaged from the bottle.

12. The sleeve of claim 11 wherein the pinch is monoaxial in orientation.

13. The sleeve of claim 12 wherein a major diameter of the sleeve at the pinch along the axis is greater than at least one of the diameter of the sleeve at the first opening and the diameter of the sleeve at the second opening.

14. The sleeve of claim 13 wherein the minor diameter of the sleeve at the pinch across the axis is less than at least one of the diameter of the sleeve at the first opening and the diameter of the sleeve at the second opening.

15. The sleeve of claim 1, wherein the sleeve is made of silicone.

16. The sleeve of claim 1, wherein the sleeve is not engaged with the glass bottle, the sleeve has a flat bottom and an inward curve between a sidewall and the flat bottom.

17. The sleeve of claim 15, wherein the sidewall has an inward curve at the top of the sidewall, such that when the elastomeric silicone sleeve is engaged with the glass bottle the elastomeric silicone sleeve is wrapped snugly around a top corner of the glass bottle, thereby providing impact protection to the glass bottle.

* * * * *